US008944350B2

(12) United States Patent
Lin

(10) Patent No.: US 8,944,350 B2
(45) Date of Patent: Feb. 3, 2015

(54) AERATED SHOWER HEAD STRUCTURE

(71) Applicant: Xiamen Runner Industrial Corporation, Xiamen (CN)

(72) Inventor: Chun-Hui Lin, Xiamen (CN)

(73) Assignee: Xiamen Runner Industrial Corporation, Xiamen (CN)

( * ) Notice: Subject to any disclaimer, the term of this patent is extended or adjusted under 35 U.S.C. 154(b) by 0 days.

(21) Appl. No.: 14/072,514

(22) Filed: Nov. 5, 2013

(65) Prior Publication Data

US 2014/0145010 A1 May 29, 2014

(30) Foreign Application Priority Data

Nov. 23, 2012 (CN) ..... 2012 2 0626321 U

(51) Int. Cl.

| | |
|---|---|
| ***E03C 1/08*** | (2006.01) |
| ***E03C 1/084*** | (2006.01) |
| ***B05B 1/18*** | (2006.01) |
| ***B05B 7/04*** | (2006.01) |

(52) U.S. Cl.

CPC ..... *B05B 1/185* (2013.01)
USPC ..... 239/428.5; 239/427; 239/525; 239/548; 239/555; 239/567; 239/569; 261/116

(58) Field of Classification Search

CPC ..... B05B 7/0425; E03C 1/084
USPC ..... 239/398, 427, 428.5, 525, 548, 567, 239/569, 554, 555; 261/DIG. 22, 116
See application file for complete search history.

(56) References Cited

U.S. PATENT DOCUMENTS

| | | | | | |
|---|---|---|---|---|---|
| 2,812,168 | A | * | 11/1957 | Kumpman | 261/71 |
| 3,286,935 | A | * | 11/1966 | Corlett et al. | 239/428.5 |
| 4,211,368 | A | * | 7/1980 | Legros et al. | 239/315 |
| 5,154,355 | A | * | 10/1992 | Gonzalez | 239/428.5 |
| 2013/0248621 | A1 | * | 9/2013 | Huang | 239/428.5 |

* cited by examiner

*Primary Examiner* — Len Tran
*Assistant Examiner* — Cody Lieuwen
(74) *Attorney, Agent, or Firm* — Chun-Ming Shih

(57) ABSTRACT

An aerated shower head structure has a body, a stationary disc, a water distributor and a pressing disc sequentially assembled. The stationary disc has an air inlet hole and a water inlet hole both formed through the stationary disc and communicating with a water inlet of the body. The water distributor and the pressing disc are combined and rotatably mounted under the stationary disc. The water distributor has an air compartment and a water compartment separately formed in a bottom of the water distributor, and has an air channel selectively communicating with the air compartment and multiple water orifices selectively communicating with the water compartment. The pressing disc has an air outlet hole communicating with the air compartment, a water outlet hole communicating with the water compartment, and an elongated water passage communicating with the air outlet hole and the water outlet hole and constitute a water outflow path.

4 Claims, 6 Drawing Sheets

AERATED SHOWER HEAD STRUCTURE

BACKGROUND OF THE INVENTION

1. Field of the Invention

The present invention relates to bathroom equipment, and more particularly to an aerated hand shower head structure capable of effectively increasing air suction, forming high oxygen-containing bubble water, and providing better water outflow effect.

2. Description of the Related Art

Bubble water is also called oxygen-containing water, which is water stream mixed with air sucked in the course of discharging water in a shower head and is sprayed from the shower head. Because of a percentage of air contained in bubble water, bubble water gives a silky and water-abundant touch on the skin of people taking a shower, and also increases water utilization efficiency to enhance water-saving effect to a certain extent. Accordingly, bubble water improves the shortcomings of straight-stream water sprayed out of conventional shower heads as far as impact force and water abuse is concerned, and has therefore become a preferable water flow mode widely accepted by the shower head industry and users. An aerated shower head structure with internal structure improvement is thus brought into play to increase air-sucking capability and generate high oxygen containing bubble water.

SUMMARY OF THE INVENTION

The objective of the present invention is to provide an aerated shower head structure capable of effectively increasing air suction, forming high oxygen-containing bubble water, and providing better water outflow effect.

To achieve the foregoing objective, the aerated shower head structure has a body, a stationary disc, a water distributor, a pressing disc and a water outflow assembly.

The body has a water inlet adapted to connect to a water source.

The stationary disc is securely mounted inside the body and has a chamber, at least one air inlet hole and at least one water inlet hole.

The chamber is defined between the stationary disc and the body.

The at least one air inlet hole is formed through the stationary disc.

The at least one water inlet hole is formed through the stationary disc and communicates with a water inlet of the body.

The water distributor is mounted inside the body and on a bottom of the stationary disc and has at least one air compartment, at least one water compartment, at least one air channel, multiple water orifices.

The at least one air compartment and the at least one water compartment are formed in a bottom of the water distributor, and are spaced apart from each other.

The at least one air channel is formed in a top of the water distributor. Each of the at least one air channel selectively communicates with a corresponding air inlet hole and a corresponding air compartment of the stationary disc.

The water orifices are formed through the water distributor and are circularly arranged on the top of the water distributor. Each water orifice communicates with a corresponding water inlet hole and a corresponding water compartment.

The pressing disc is combined with the water distributor to be rotatably and hermetically mounted on a bottom of the stationary disc, is located under the water distributor, and has at least one air outlet hole, at least one water outlet hole and at least one water outlet hole.

The at least one air outlet hole is formed through the pressing disc and respectively communicates with the at least one air compartment of the water distributor.

The at least one water outlet hole is formed in a top of the pressing disc and respectively communicates with the at least one water compartment of the water distributor.

The at least one elongated water passage is formed in a bottom of the pressing disc, and respectively communicates with the at least one air outlet hole and the at least one water outlet hole.

The water outflow assembly is mounted on a bottom of the pressing disc.

The chamber inside the stationary disc and a gap defined between an inner sidewall of the body and each of the stationary disc, the water distributor, and the pressing disc constitute an air inflow path.

The at least one elongated water passage of the pressing disc communicates with the water outflow assembly to constitute a water outflow path.

Preferably, each of the at least one elongated water passage has a first water chamber and a second water chamber sequentially arranged in a direction of water flow inside the elongated water passage, and an inner diameter of the second water chamber is greater than an inner diameter of the first water chamber.

Preferably, each of the at least one elongated water passage has a water exit communicating with the second water chamber, and a distance from the water exit to a corresponding air outlet hole of the pressing disc is four times above a distance from the corresponding air outlet hole to a corresponding water outlet hole of the pressing disc.

Preferably, the body has a stopper formed on a bottom surface of the body, the pressing disc has multiple limit bosses formed on the pressing disc, and each limit boss is selectively aligned with the stopper of the body.

Given the foregoing structure, the aerated shower head structure employs the at least one elongated water passage to generate a negative pressure effect when water flows through the water passage, rendering higher air suction in sucking abundant air into the shower head. The aerated shower head structure has higher suction in sucking air therein than a conventional shower head structure, thereby sucking sufficient air into the shower head in generation of bubble water with a silky, comfortable and water-abundant touch.

DETAILED DESCRIPTION OF THE INVENTION

Figure 1:
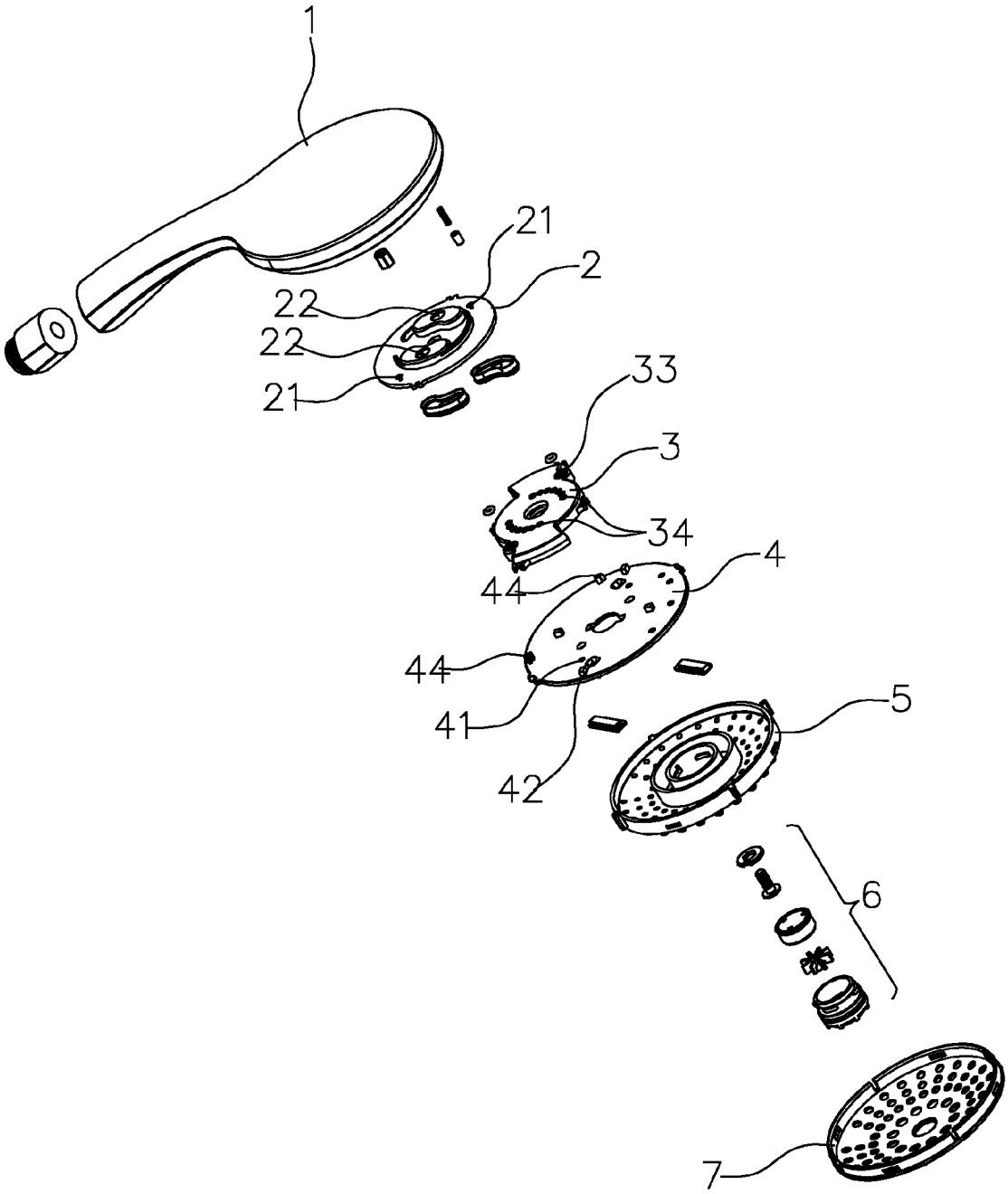
FIG. 1 is an exploded perspective view of an aerated shower head structure in accordance with the present invention.
Figure 2:
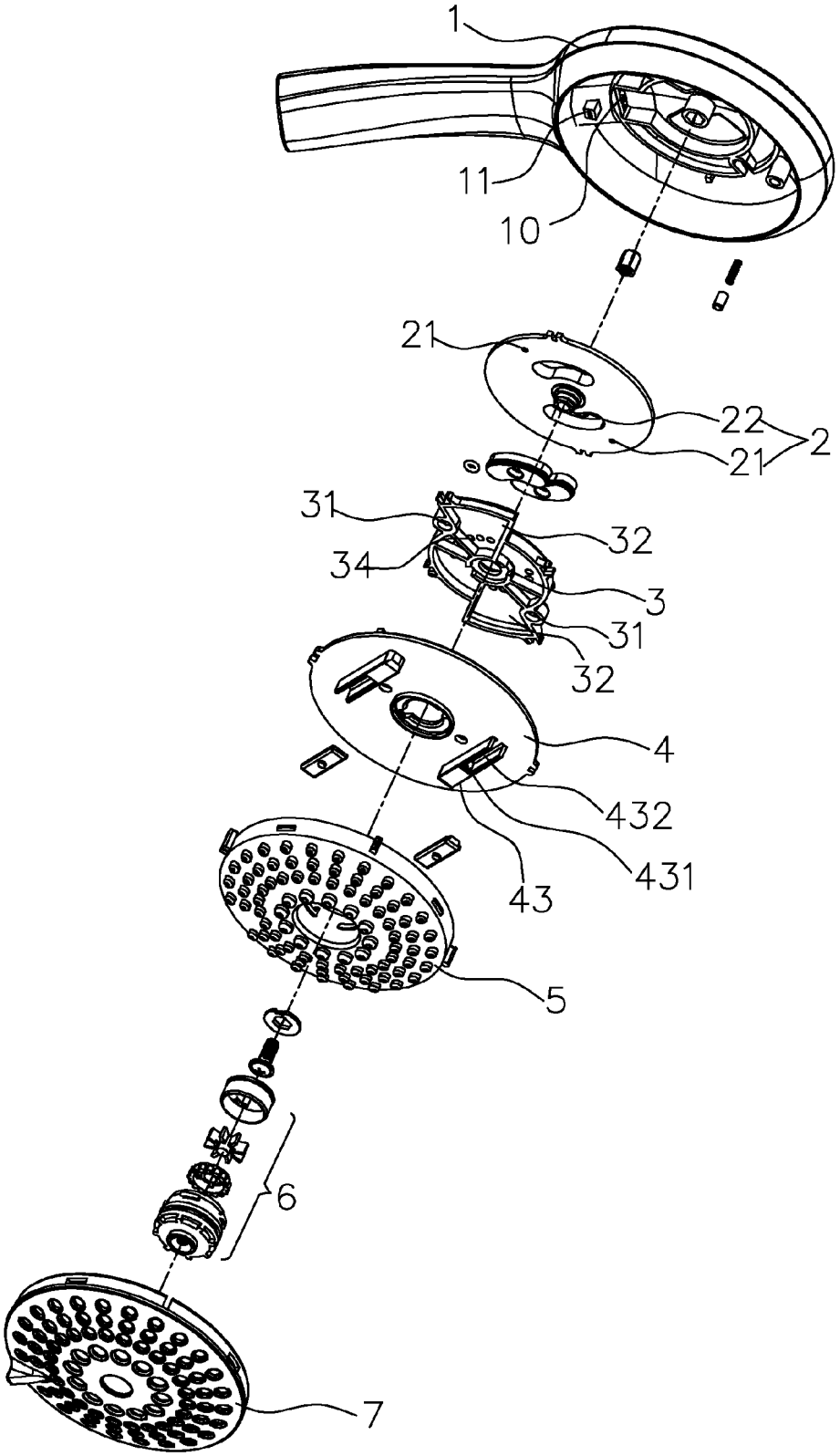
FIG. 2 is another exploded perspective view of an aerated shower head structure in accordance with the present invention.
Figure 3:
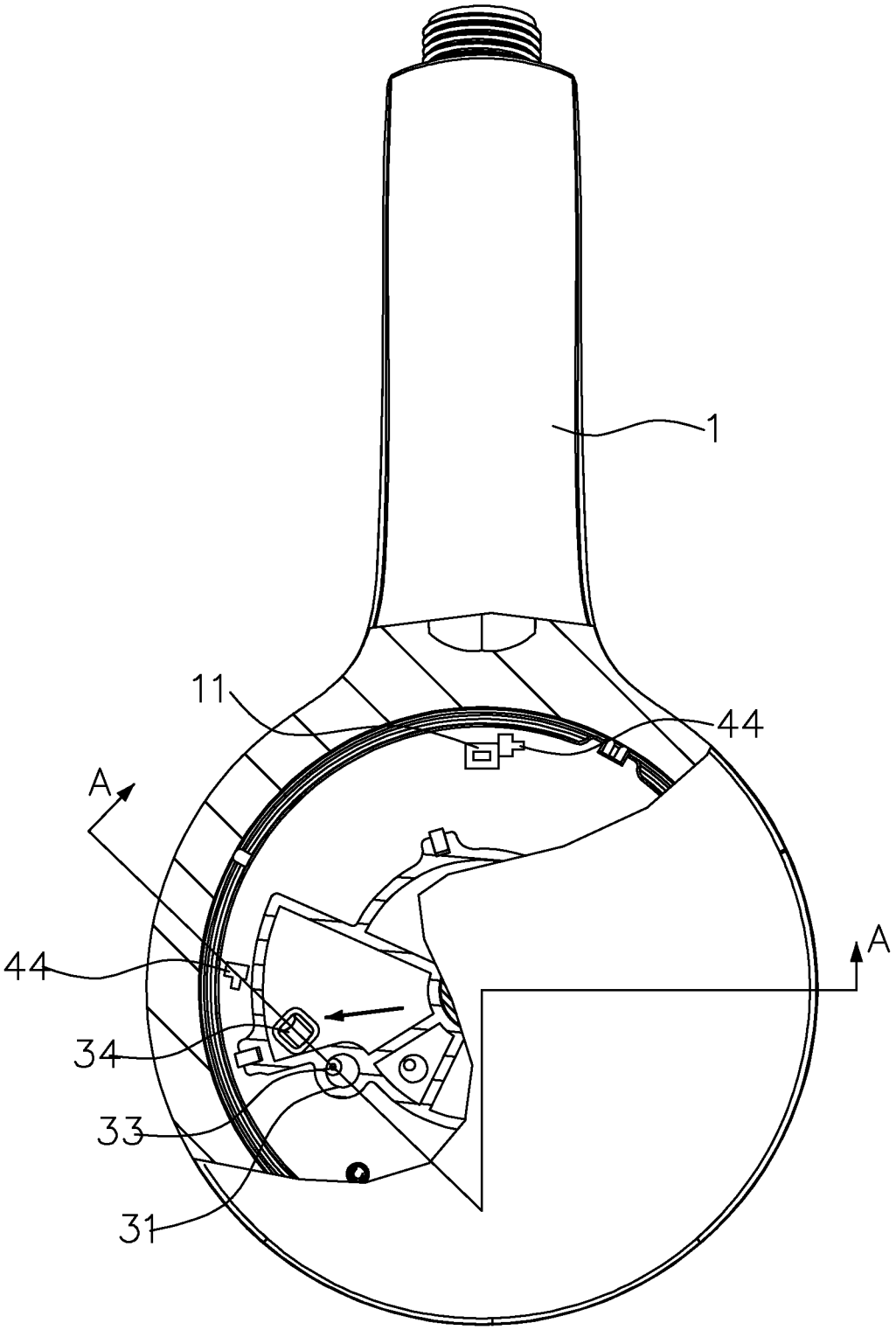
FIG. 3 is an operational top view in partial section of the aerated shower head structure in FIG. 1.

With reference to FIGS. 1 to 6, an aerated shower head structure in accordance with the present invention has a body 1, a stationary disc 2, a water distributor 3, a pressing disc 4, an outflow disc 5, a filtering assembly 6 and a decorative cover 7.

The body 1 has a water inlet 10 and a stopper 11. The water inlet 10 is connected to a water source. The stopper 11 is formed on a bottom of the body 1.

The stationary disc 2, the distributing disc 3, and the pressing disc 4 are combined and mounted inside the body 1. A water outflow assembly is combined by the outflow disc 5, the filtering assembly 6 and the decorative cover 7 and is mounted on a bottom of the pressing disc 4. The water outflow assembly is not repeated here as being structurally similar to conventional outflow assemblies.

The stationary disc 2 is securely mounted on the bottom of the body 1. A chamber is defined between the stationary disc 2 and the body 1 for air storage. The chamber and a gap defined between an inner sidewall of the body 1 and each of the stationary disc 2, the water distributor 3, and the pressing disc 4 constitute an air inflow path. The stationary disc 2 has two air inlet holes 21 and two water inlet holes 22. The air inlet holes 21 are formed through the stationary disc 2 and communicate with the air inflow path. The water inlet holes 22 are formed through the stationary disc 2 and communicate with the water inlet 10 of the body 1.

The water distributor 3 is mounted on a bottom of the stationary disc 2, and has two air compartments 31, two water compartments 32, two air channels 33 and multiple water orifices 34. The air compartments 31 and the water compartments 32 are formed in a bottom of the water distributor 3, and are spaced apart from each other. The air channels 33 are formed in a top of the water distributor 3, and each of the air channels 33 communicates with a corresponding air inlet hole 21 and a corresponding air compartment 31. The water orifices 34 are formed through the water distributor 3. Each water orifice 34 communicates with a corresponding water inlet hole 22 and a corresponding water compartment 32. The water orifices 34 are circularly arranged on the top of the water distributor 3 to selectively communicate with the water inlet holes 22 of the stationary disc 2 and the water inlet 10 of the body 1 when the water distributor 3 and the pressing disc 4 are rotated relative to the stationary disc 1.

Figure 4:
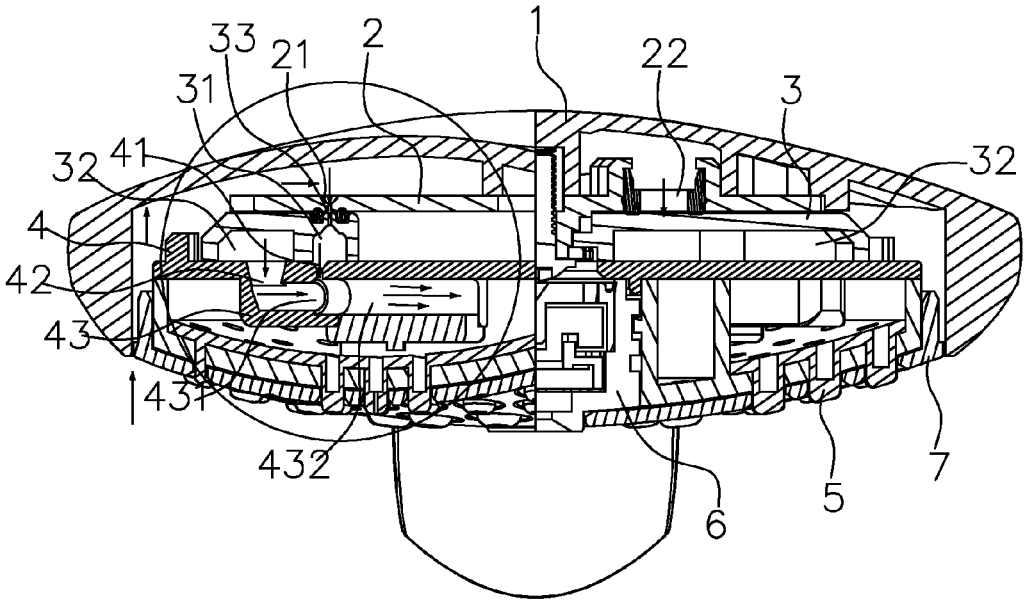
FIG. 4 is a cross-sectional view of the aerated shower head structure viewed along line A-A in FIG. 3.
Figure 4A:
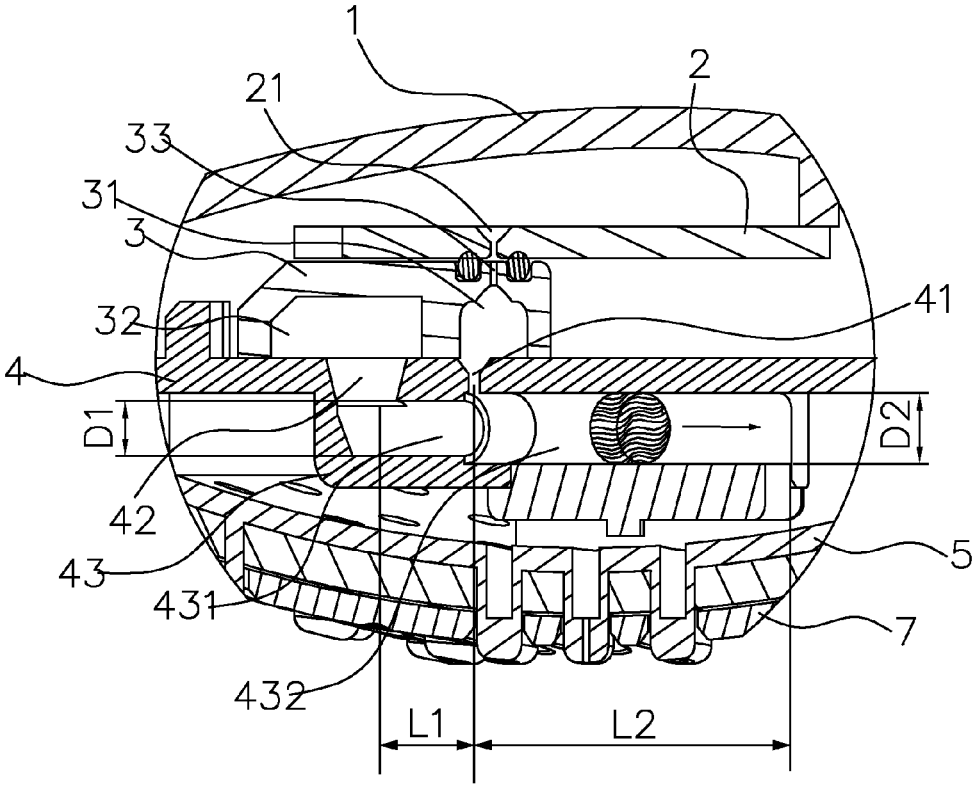
FIG. 4A is a partially enlarged cross-sectional view of the aerated shower head structure in FIG. 4.

The pressing disc 4 is combined with the water distributor 3 to be rotatably and hermetically mounted on a bottom of the stationary disc 2. The pressing disc 4 has two air outlet holes 41, two water outlet holes 42, and two elongated water passages 43. The air outlet holes 41 are formed through the pressing disc 4 and respectively communicates with the air compartments 31 of the water distributor 3. The water outlet holes 42 are formed in a top of the pressing disc 4 and respectively communicates with the water compartments 32. The elongated water passages 43 are formed in a bottom of the pressing disc 4, and respectively communicates with the air outlet holes 41 and the water outlet holes 42. The elongated water passages 43 communicate with the outflow disc 5 of the water outflow assembly to constitute a water outflow path. Each of the at least one elongated water passage 43 has a first water chamber 431 and a second water chamber 432 sequentially arranged in a direction of water flow inside the elongated water passage 43. An inner diameter D2 of the second water chamber 432 is greater than an inner diameter D1 of the first water chamber 431. In other words, a cross-sectional area of the second water chamber 432 for water to flow through is greater than that of the first water chamber 431. With further reference to FIGS. 4 and 4A, each of the elongated water passages 43 has a water exit communicating with the second water chamber 432 of the elongated water passage 43, and a distance L2 from water exit to a corresponding air outlet hole 41 is four times above a distance L1 from the air outlet hole 41 to a corresponding water outlet hole 42.

Given the foregoing structure, the operation of the aerated shower head structure is described as follows. When water flows through the water holes 22 of the stationary disc 2, the water orifices 34 of the water distributor 3 and the water outlet holes 42 and enters the elongated water passages 43, the water inside the elongated water passages 43 generates flow movement similar to piston motion. The air outlet holes 41 suck passing air therein with a suction force generated at the at least one air outlet hole 41. Meanwhile, due to the area variation between the cross sections at the first water chamber 431 and the second water chamber 432, a negative pressure zone is formed arising from the cross-sectional area variation according to the venturi tube theory when water flows through the first water chamber 431 and the second water chamber 432. The effect of the negative pressure gives rise to higher suction inside the elongated water passages 43, thereby sucking more air into the elongated water passages 43 and generating bubble water containing abundant oxygen after the sucked air is mixed with water.

Figure 5:
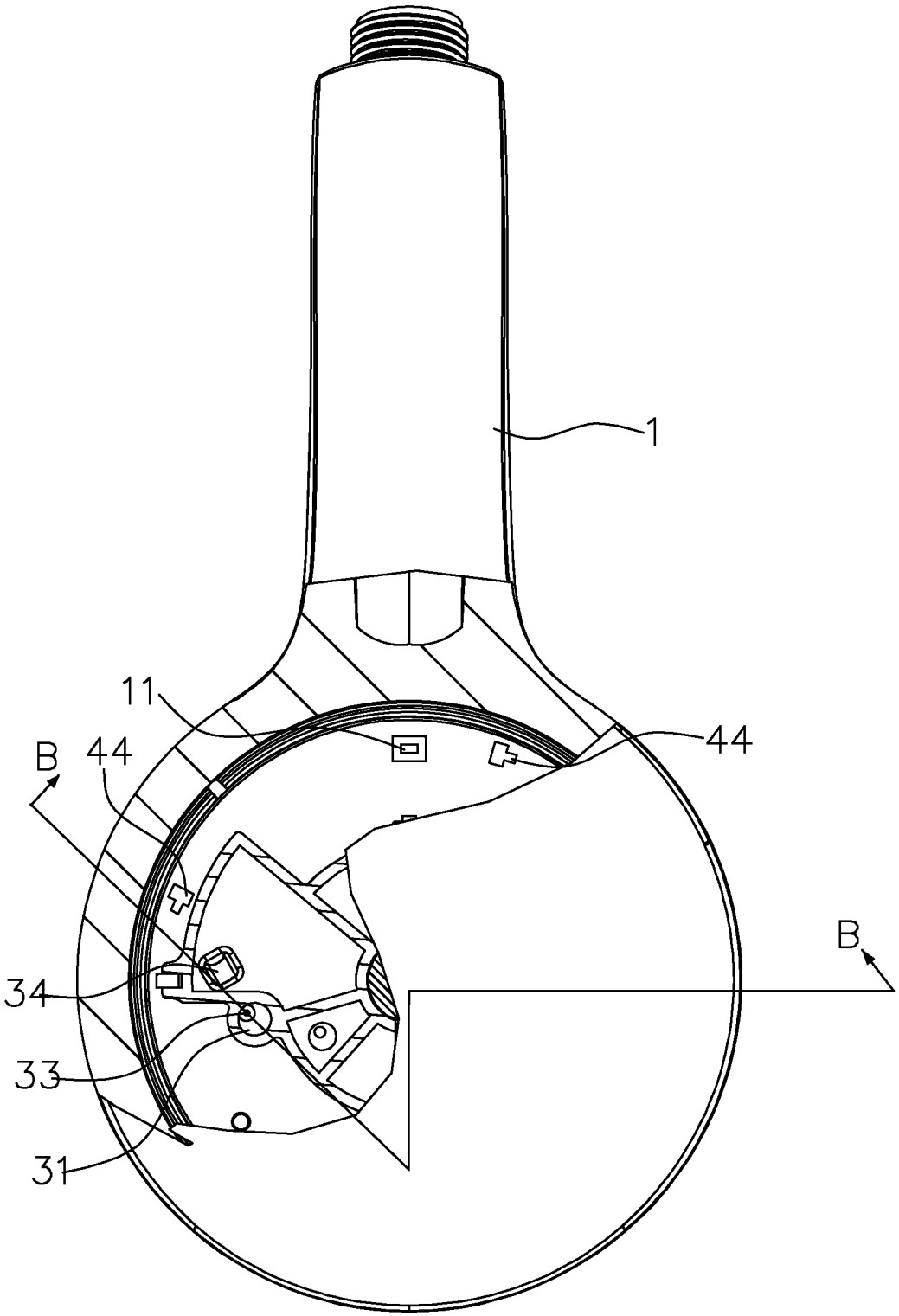
FIG. 5 is another operational top view in partial section of the aerated shower head structure in FIG. 1.
Figure 6:
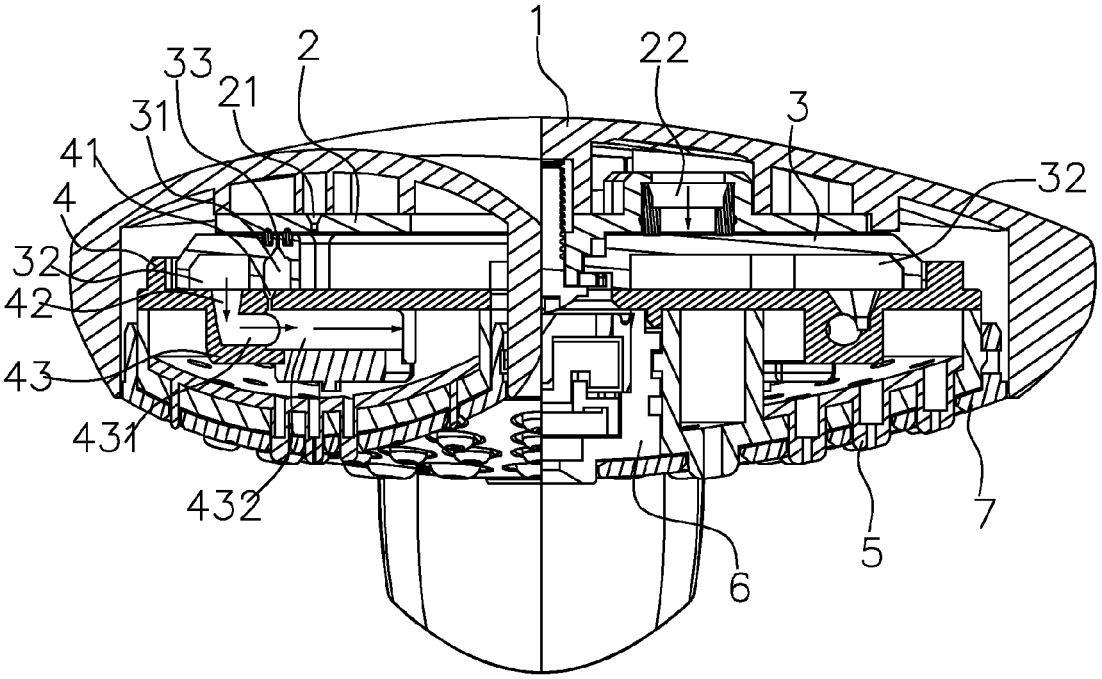
FIG. 6 is a cross-sectional view of the aerated shower head structure viewed along line B-B in FIG. 5.

Besides the foregoing structure, the pressing disc 4 has multiple limit bosses 44 formed on the pressing disc 4. Each limit boss 44 is selectively aligned with the stopper 11 of the body 1 at a time. When the pressing disc 4 and the water distributor 3 are rotated relative to the stationary disc 2 and one of the limit bosses 44 is aligned with the stopper 11, the air channels 33 of the water distributor 3 respectively communicates with the air inlet holes 21 of the stationary disc 2 and the air outlet holes 41 of the pressing disc 4, such that water flowing through the elongated water passages 43 sucks air into the elongated water passages 43 and the aerated shower head structure is in a state of spraying bubble water as shown in FIGS. 4 and 4A. When the pressing disc 4 is rotated relative to the water distributor 3 and the limit boss 44 is not aligned with the stopper 11, the air channels 33 of the water distributor 3 do not communicate with the air inlet holes 21 of the stationary disc 2 and air is unable to enter, such that the water flowing through the elongated water passages 43 can suck no air and the aerated shower head structure is in a state of spraying regular water as shown in FIGS. 5 and 6.

In sum, the aerated shower head structure has higher suction in sucking air therein than a conventional shower head structure, thereby sucking sufficient air in the shower head in generation of bubble water with a silky, comfortable and water-abundant touch.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. An aerated shower head structure, comprising:

a body having a water inlet adapted to connect to a water source;

a stationary disc securely mounted inside the body and having:

a chamber defined between the stationary disc and the body;

at least one air inlet hole formed through the stationary disc; and at least one water inlet hole formed through the stationary disc and communicating with the water inlet of the body;

a water distributor mounted inside the body and on a bottom of the stationary disc and having:

at least one air compartment and at least one water compartment formed in a bottom of the water distributor, and spaced apart from each other;

at least one air channel formed in a top of the water distributor, each of the at least one air channel selectively communicating with a corresponding air inlet hole and a corresponding air compartment of the water distributor; and multiple water orifices formed through the water distributor and circularly arranged on the top of the water distributor, each water orifice communicating with a corresponding water inlet hole and a corresponding water compartment;

a pressing disc combined with the water distributor to be rotatably and hermetically mounted on a bottom of the stationary disc, located under the water distributor, and having:

at least one air outlet hole formed through the pressing disc and respectively communicating with the at least one air compartment of the water distributor;

at least one water outlet hole formed in a top of the pressing disc and respectively communicating with the at least one water compartment of the water distributor; and at least one elongated water passage formed in a bottom of the pressing disc, and respectively communicating with the at least one air outlet hole and the at least one water outlet hole; and a water outflow assembly mounted on a bottom of the pressing disc;

wherein the chamber inside the stationary disc and a gap defined between an inner sidewall of the body and each of the stationary disc, the water distributor, and the pressing disc constitute an air inflow path; and the at least one elongated water passage of the pressing disc communicates with the water outflow assembly to constitute a water outflow path.

2. The aerated shower head structure as claimed in claim 1, wherein each of the at least one elongated water passage has a first water chamber and a second water chamber sequentially arranged in a direction of water flow inside the elongated water passage, and an inner diameter of the second water chamber is greater than an inner diameter of the first water chamber.

3. The aerated shower head structure as claimed in claim 1, wherein each of the at least one elongated water passage has a water exit communicating with a second water chamber, and a distance from the water exit to a corresponding air outlet hole of the pressing disc is four times above a distance from the corresponding air outlet hole to a corresponding water outlet hole of the pressing disc.

4. The aerated shower head structure as claimed in claim 1, wherein the body has a stopper formed on a bottom surface of the body, the pressing disc has multiple limit bosses formed on the pressing disc, and each limit boss is selectively aligned with the stopper of the body.

* * * * *